United States Patent [19]

Hannon

[11] 4,025,665

[45] May 24, 1977

[54] PROCESS FOR COATING SURFACES WITH METAL-CONTAINING POWDER COATING COMPOSITIONS

[75] Inventor: Martin J. Hannon, Martinsville, N.J.

[73] Assignee: Celanese Corporation, New York, N.Y.

[22] Filed: Dec. 19, 1975

[21] Appl. No.: 642,416

[52] U.S. Cl. ..... 427/192; 427/195; 427/348; 427/378; 427/383 R; 106/290

[51] Int. Cl.[2] ..... B05D 1/06

[58] Field of Search ..... 427/348, 349, 372 R, 427/378, 383, 192, 195; 106/290

[56] References Cited

UNITED STATES PATENTS

| | | | |
|---|---|---|---|
| 2,827,388 | 3/1958 | Mayer et al. | 106/290 |
| 3,136,654 | 6/1964 | Craver | 427/378 |
| 3,939,114 | 2/1976 | Camelon et al. | 427/195 |
| 3,941,731 | 3/1976 | Camelon et al. | 427/195 |

OTHER PUBLICATIONS

Burns et al., Protective Coatings for Metals, pp. 410–411, New York: Reinhold Publishing Co., 1955.

*Primary Examiner*—Ralph S. Kendall
*Assistant Examiner*—Charles R. Wolfe, Jr.

[57] ABSTRACT

The metal platelets contained in a metal-containing powder coating composition may be oriented substantially parallel to a surface coated with this composition by the process herein described. This process comprises (a) coating the metal-containing powder coating composition on the surface, (b) heating the coated surface in order to melt the metal-containing powder coating composition, (c) simultaneous with the heating step, blowing a stream of hot fluid substantially parallel to the coated surface so as to orient the metal platelets substantially parallel to the surface, and (d) cooling the coated surface after the metal platelets have become oriented substantially parallel to the surface.

Contoured surfaces coated in accordance with this process have an appearance of depth similar to that obtained using a solvent system metallic paint.

8 Claims, No Drawings

PROCESS FOR COATING SURFACES WITH METAL-CONTAINING POWDER COATING COMPOSITIONS

BACKGOUND OF THE INVENTION

1. Field of the Invention

The present invention relates generally to processes for coating surfaces. More particularly, the present invention describes a process for coating surfaces with metal-containing powder coating compositions such that the final coated surfaces contain metal platelets oriented substantially to the surfaces.

2. Summary of the Prior Art

In coating contoured surfaces with conventional solvent system metallic paints (i.e., paints containing metal platelets or flakes suspended within a solution), the metal platelets in the coating tend to orient substantially parallel to the surface being coated. This produces the effect that when looking at the coating face-on it looks bright, but when looking at it substantially edge-on (i.e., at a small angle to the surface), it looks darker. Thus, there results an appearance of depth on the contoured surfaces of metallic painted articles.

The same effect has not been achieved, however, with metallic powder coatings. On the contrary, when metallic powder coatings are applied to surfaces, the metal platelets tend to assume a random configuration. This random configuration or orientation results in coated surfaces which lack the appearance of depth which may be had with conventional solvent system metallic paints.

The proper orientation of metal platelets may be achieved on vertical surfaces due solely to forces of gravity if the viscosity of the powder system is low enough for a long period of time during baking. However, regardless of the viscosity of the powder system, parallel orientation has not been achieved to date with horizontal surfaces.

The search has continued for processes for orienting metal platelets in a metal-containing powder coating composition such that, upon curing of the coating, the metal platelets assume an orientation parallel to the surface. The present invention has resulted from that search.

OBJECTS AND SUMMARY OF THE INVENTION

Accordingly, a general object of the present invention is to avoid or substantially alleviate the above problems of the prior art.

A more specific object of the present invention is to provide a process for coating a metal-containing powder coating composition on a surface such that the metal platelets assume an orientation substantially parallel to the surface.

A still more specific object of the present invention is to provide a process for coating a metal-containing powder coating composition on a horizontal surface such that the metal platelets assume an orientation substantially parallel to the horizontal surface.

Another object of the present invention is to provide a process for coating a metal-coating powder coating composition on a surface such that the metal platelets assume an orientation substantially parallel to the surface, regardless of the viscosity of the resin composition when molten.

Other objects and advantages of the invention will become apparent from the following summary and description of the preferred embodiments of the present invention.

The present invention provides a process for coating a metal-containing powder coating composition on a surface such that, upon curing of the resin, the metal platelets assume an orientation substantially parallel to the surface. The metal-containing powder coating composition comprises resin, and metal platelets and substantially no solvent. The process comprises (a) coating the metal-coating powder coating composition on a surface, (b) heating the coated surface in order to melt the metal-containing powder coating composition, (c) simultaneous with said heating step (b) blowing a stream of hot fluid parallel to the coated surface so as to orient the metal platelets parallel to the surface, and (d) cooling the coated surface after the metal platelets have become oriented substantially parallel to the surface.

The essence of the present invention is the discovery that surfaces may be coated with metal-containing powder coating compositions and the metal platelets in the powder coating composition may be oriented substantially parallel to the surfaces without regard to the viscosity of the molten powder coating composition and without regard to whether or not the surface is vertical, horizontal, or otherwise inclined. This substantially parallel orientation results from the blowing of a stream of hot fluid substantially parallel to the coated surface and simultaneously heating the coated surface in order to melt the metal-containing powder coating composition.

DESCRIPTION OF THE PREFERRED EMBODIMENTS

The present invention may be applied to generally all surfaces, whether horizontal, vertical, or otherwise inclined. The present process is particularly applicable to horizontal surfaces and those vertical surfaces which must be coated with powder systems having viscosities high enough during baking that the metal platelets cannot be oriented substantially parallel to the vertical surface by employing forces of gravity alone. The present process may also be applied to contoured surfaces. This may be achieved either by (1) applying several different streams of hot fluid substantially parallel to the various surfaces and/or (2) applying a single stream of hot fluid directed such that any injected fluid travels in a direction substantially parallel to the contoured surfaces.

The metal-containing powder coating compositions as described hereinabove comprise resin, curing agent, metal platelets and substantially no solvent. The metal-containing powder coating compositions may be prepared by any method known to those skilled in the art. Particularly efficacious methods for preparing these metal-containing powder coating compositions are described in copending U.S. Pat. application Ser. No. 642,415 which was filed on Dec. 19, 1975, of John W. Soehngen and Martin J. Hannon entitled "Process for Preparing Shear Degradable Particle-Containing Resin Powders," and which is assigned to the assignee of the present invention, and U.S. Pat. application Ser. No. 649,128, which was filed on Jan. 14, 1976, of Marvin Gordon, Martin J. Hannon, and Henry H. George Jr. entitled "Improved Metal Containing Powder Coating Compositions and Process for Their Preparation," and which is also assigned to the assignee of the present invention. Both of these applications are herein incorporated by reference.

The resin which is employed in the process of the present invention is used to provide the solid matrix which surrounds the metal platelets or flakes. Any resin which will cure in the presence of a curing agent at a particular minimum temperature (as discussed hereinbelow) to form a suitable coating such as an automobile or home appliance topcoat may be used in the present process. In addition, thermoplastic resins which do not require cure but which have molecular weights high enough as is, without chain crosslinking, may also be used.

Such resins include polyacrylates, polyepoxies, polyesters, polyolefins, cellulosic esters, polyacetals, polyamides, alkyds, polyethers, vinyl resins, polyurethanes, and silicones.

Thus, the polymers suitable for use in the present invention include both thermosplastic and thermosetting polymers. Since the methods for preparing these polymers are so well known in this art, no discussion of such methods need be presented herein.

Polyacrylates are particularly preferred polymers for use in the process of the present invention. The term "polyacrylate" as use herein includes any polymer, whether thermosetting or thermoplastic, which is prepared by the free-radical addition polymerization of one of more ethylenically unsaturated monomers, at least 50 weight percent of which is selected from the group consisting of acrylic and methacrylic acid, alkyl, cycloalkyl, and arylalkyl esters of acrylic and methacrylic acids, wherein the ester moiety contains from 1 to about 18 carbon atoms, and the hydroxyalkyl esters of acrylic and methacrylic acids wherein the hydroxyalkyl moiety contains from 2 to about 10 carbon atoms.

Examples of suitable alkyl, cycloalkyl, arylalkyl, and hydroxyalkyl esters of acrylic and methacrylic acids include, among others, methyl acrylate, ethyl acrylate, isopropyl acrylate, n-butyl acrylate, t-butyl acrylate, 2-ethylhexyl acrylate, dodecyl acrylate, octadecyl acrylate, methyl methacrylate, n-butyl methacrylate, 2-ethylhexyl methacrylate, octyl methacrylate, tridecyl methacrylate, hexadecyl methacrylate, cyclohexyl acrylate, cyclohexyl methacrylate, benzyl acrylate, benzyl methacrylate, isobornyl acrylate, isobornyl methacrylate, beta-hydroxyethyl acrylate, beta-hydroxypropyl acrylate, beta-hydroxybutyl methacrylate, gamma-hydroxypropyl methacrylate, beta-hydroxybutyl acrylate, gamma-hydroxybutyl methacrylate, deltahydroxybutyl acrylate, beta-hydroxyoctyl acrylate and beta-hydroxydecyl methacrylate.

The remaining 50 weight percent or less of said ethylenically unsaturated monomers consists of at least one monomer selected from the group consisting of:

1. acrylic monomers other than those cited hereinabove, which monomers generally encompass aryl and reactive esters of acrylic and methacrylic acids; such as phenyl acrylate, phenyl methacrylate, aziridinyl acrylate, glycidyl methacrylate, 2-aminoethyl acrylate, 2-aminopropyl methacrylate, 3-aminopropyl methacrylate, and the like;

2. ethacrylic and crotonic acids and esters thereof, such as ethyl ethacrylate, methyl crotonate, octyl ethacrylate, heptyl crotonate, octadecyl ethacrylate, cyclohexyl ethacrylate, benzyl crotonate, phenyl ethacrylate, and the like;

3. amides, alkylol amides, and alkoxyalkyl amides of acrylic, methacrylic, and crotonic acids, wherein the alkyl moieties contain from 1 to about 4 carbon atoms and the alkoxy moiety contains from 1 to about 8 carbon atoms, specific examples being acrylamide, methacrylamide, crotonamide, methylol acrylamide, methoxymethyl methacrylamide, butoxymethyl acrylamide, 2-ethyl-hexoxymethyl methacrylamide, diacetone acrylamide, and the like;

4. alpha, beta-ethylenically-unsaturated dicarboxylic acids and anhydrides, such as maleic acid, maleic anhydride, fumaric acid, itaconic acid, mesaconic acid and the like;

5. mono- and diesters of alpha, beta-ethylenically-unsaturated dicarboxylic acids, examples of which esters are fumaric acid monoethyl ester, dimethyl itaconate, dipropyl mesaconate, diisopropyl maleate, dicyclohexyl maleate, maleic acid mono (beta-hydroxyethyl) esters, and the like;

6. alpha, beta-ethylenically-unsaturated nitriles, such as acrylonitrile, methacrylonitrile, ethacrylonitrile, crotonic nitrile, and the like;

7. vinyl aromatic compounds such as styrene, vinyltoluene, vinylnaphthalene, chlorostyrene, bromostyrene, and the like;

8. monounsaturated hydrocarbons, such as ethylene, propylene, and the like;

9. no more than about 10 weight percent of vinyl esters of aliphatic monocarboxylic acids having from 1 to about 18 lcarbon atoms, such as vinyl acetate, vinyl propionate vinyl octanoate, vinyl stearate, and the like; and 10. no more than about 10 weight percent of halogen-containing unsaturated hydrocarbons, such as vinyl chloride, vinyl fluoride, vinylidene chlorides, vinylidene fluoride, and the like.

Mixtures of two or more such resins may also be used as long as compatible and do not cause phase separation which may result in surface coating defects such as craters, pinholes, pits, etc.

The metal-containing powder coating composition may contain generally from about 55 to about 95, typically from about 60 to about 90, and preferably from about 65 to about 85% by weight resin based upon the total weight of the final composition.

By the term "metal platelet" as used in the instant specification is meant any metal platelet which may be useful in a topcoat for, e.g., automobiles, home appliances, etc. Such metal platelets include aluminum flake, bronze flake, zinc flake, magnesium flake, copper flake, gold flake, silver flake, platinum flake, and other platelets such as mica, glass, stainless steel, coated mica, coated glass, and aluminum-coated polyester film fragments. Mixtures of two or more metal platelets may also be used. Aluminum flake is a preferred metal for use in the present invention.

The metal is preferably in a platelet or flake form because of improved reflectance properties of platelets or flakes. The metal platelet is present in the metal-containing powder coating composition in an amount of generally from about 0.5 to about 30, typically from about 1 to about 10, and preferaby from about 1.25 to about 5% by total weight of the metal-containing powder coating composition.

A curing agent may be employed in the process of the present invention to cure or cross link the resin after it has been applied to the coated surface. The curing agents useful in this process are not activated until a certain critical minimum temperature is reached. At that temperature, and at temperatures in excess of that minimum, the curing agent is activated so as to cure or cross link the resin of the metal-containing powder coating composition.

Thus, the powder particles may be first applied (e.g., electrostatically) to a surface and then the coated surface is heated or baked so as to first cause the resin to melt and flow, then to activate the curing agent and thereby cross link the resin.

Typical curing agents include any multifunctional isocyanates such as toluene diisocyanate, melamines, polycarboxylic acids, polyols, hydroxycarboxylic acids, polyamines, hydroxylamines, and other compounds known to those skilled in this art.

A particularly preferred curing agent comprises a blocked triisocyanate, prepared by reacting three moles of 1-isocyanato-3-isocyanatomethyl-3,5,5-trimethylcyclohexane with 1 mole of 1,1,1,-tris-(hydroxymethyl) propane in methyl isobutyl ketone followed by blocking with methyl ethyl ketoxime.

The curing agent may be present in small amounts, generally from about 5 to about 45, typically from about 10 to about 35, and preferably from about 15 to about 30% by total weight of the metal-containing powder coating composition.

The metal-containing powder coating composition of the present invention may also contain a pigment if additional color is desired in the final metal-containing powder coating composition. The pigments useful in the present invention include conventional pigments such as phthalocyanine blue pigment, chromium green pigment, diazo red pigment, carbon black, titanium dioxide, and many others known to those skilled in this art.

The pigment may be used in rather small amounts, generally from about 1 to about 20, typically from about 1 to about 10, and preferably from about 1 to about 5% by weight based upon the total weight of the metal-containing powder coating composition.

If desired, fillers, plasticizers, flow-control agents, and other additives may also be present in the metal-containing powder coating composition.

The first step of the present process requires the coating of the metal-containing powder coating composition on a surface. The coating step may be carried out in any manner known to those skilled in ther art, typically, by electrostatic spraying or by employing fluidized beds.

Electrostatic spraying processes comprise flowing the powder by means of an air stream through a gun, the tip of which contains an electrode at very high voltages (e.g., 80,000 V) which sets up a corona field in the air around the electrode. As the powder passes through the corona it picks up a charge and is conveyed by the air stream and the electrostatic field to the grounded metal workpiece.

Fluidized bed coating processes comprise fluidizing the powder in a trough by means of an air stream (and possibly also charging the powder), and allowing the metal piece (which is usually pretreated to melt the powder) to pass through the fluidized bed to pick up powder to sufficiently coat the metal piece.

The second step of the present process comprises heating the coated surface in order to melt the metal-containing powder coating composition. This step may be carried out at a temperature of generally from about 100° to about 300°, typically from about 150° to about 240°, and preferably from about 175 to about 225° C., depending, of course, upon the melting point and decomposition temperature of the particular resin employed. The coated surface is heated for a time sufficient to melt the resin and allow orientation of the metal platelets substantially parallel to the coated surface. This time is, of course, directly related to the source and position of the heat supply, but generally may be from about 3 to about 30, typically from about 5 to about 25, and preferably from about 10 to about 20 minutes.

The coated surface may be heated by any means known to those skilled in this art. Preferred means for heating the coated surface include an infrared lamp or a commercial forced air oven which encloses the entire coated surface.

When an infrared lamp is used to effect the desired heating, a 12 inch by 12 inch lamp with an intensity of 5,760 watts must be placed at a distance of about 3 inches from the surface for from about 2 to about 10 seconds in order to effect melting of the coat.

The third step in the present process comprises blowing a stream of hot fluid substantially parallel to the coated surface simultaneously with the heating step so as to orient the metal platelets in a direction substantially parallel to the surface. The fluid flow must not only be in a direction substantially parallel to the surface but must also create a velocity shear gradient transverse to the thickness of the coating due to the fact that the resin at the interface with the metal piece has a zero velocity whereas the resin at the interface with the hot fluid has a finite velocity due to the effect of the hot fluid upon the resin. This shear gradient effects the desired change in orientation.

The hot fluid may include any gas or gaseous mixture which may effect the desired forces upon the resin which in turn affects the desired shear forces which tend to orient the metal platelets. Liquids may also be used as the fluid as long as such liquids do not interfere with the coating, such as by chemical reaction. Air is a particularly preferred fluid.

The fluid must be at a temperature which is higher than the melting point of the particular resin employed so as not to cool the resin below its melting point and thereby fix the orientation of the metal platelets in the resin prior to alignment. Thus, the fluid may be at a temperature of generally from about 100° to about 250°, typically from about 125° to about 225°, and preferably from about 150° to about 200° C.

The combined effect of the external heating of the coating and the blowing of the hot fluid substantially parallel to the coated surface is to provide a coating having a temperature of generally from about 100° to about 300°, typically from about 150° to about 225°, and preferably from about 175 to about 200° C.

It is necessary that the temperature be uniform throughout the surface which is being treated. If the temperature is not uniform, different flow behavior will result on different parts of the surface. Thus, various degrees of orientation will be present on various parts of the surface.

The velocity of the top surface of the resin and, therefore, the magnitude of the shear gradient is, of course, dependent upon the hot fluid velocity, the viscosity of the molten coating, and the distance of the hot fluid from the coated surface. When air is used as the hot fluid, a velocity of generally from about 2 to about 50, typically from about 5 to about 20, and preferably from about 7 to about 15 feet per second may be employed.

The distance of the flowing fluid from the coated surface is important because the velocity of the hot fluid will decrease if held too far from the coated surface and in addition the temperature may also drop slightly. Thus, there may be employed a distance of generally from about 0.5 to about 10, typically from about 1 to about 6, and preferably from about 2 to about 4 inches.

As the distance of the hot fluid to the surface increases, it is necessary to use a higher velocity fluid flow in order to effect proper orientation because of the above-discussed decrease in true air velocity at the coating surface.

Any apparatus which will provide a current of hot fluid substantially parallel to the coated surface may be used in the present process. Such apparatus include an air curtain, an air knife, an air gun, or an oven air blower. Another apparatus which may be used is a conventional high pressure air source blown through a high wattage heater (e.g., 1,750 watts at 115 volts) to give a hot, very high velocity air stream.

The present process may be used in painting an automobile by employing an air curtain or thin stream of pretreated hot air inside of a conventional oven in an automotive plant. When the coating is molten from the conventional oven in the conventional manner, this thin stream of pretreated air from the air knife may be brought close to the autmobile and directed parallel to the surface, and will traverse the length and contour of a car. If necessary, the car may remain in the oven longer than is conventional.

It may also be possible to use a high velocity air oven such as provided by Blu-Surf or Thermal Engineering Corp. if the direction of the air stream can be controlled.

The hot fluid is blown across the surface for a period of time long enough for the metal particles to become oriented parallel to the surface. This time will vary depending upon the viscosity of the resin and the temperature of the fluid and surface, but a flow time of generally from 1 to about 30, typically from about 5 to about 20, and preferably from about 10 to about 15 minutes may be employed.

The final step of the present process comprises cooling the coated surface when the metal particles have become oriented substantially parallel to the surface. By "cooling" is meant that the temperature of the coating is decreased to a temperature below that of the melting point of the particular resin. Thus, the temperature of the coating is decreased to a temperature of generally from about 10° to about 80°, typically from about 15° to about 40°, and preferably from about 20° to about 25° C.

The entire process may be carried out at any pressure, atmospheric, subatmospheric, or superatmospheric, although substantially atmospheric pressures are preferred.

Contoured surfaces coated in accordance with the process described hereinabove have an appearance of depth similar to that obtained using solvent system metallic paints.

The process of the present invention may, of course, be carried out in a batch, continuous or semi-continuous manner as desired. The present invention is further illustrated by the following examples. All parts and percentages in the examples as well as in the specification and claims are by weight unless otherwise specified.

EXAMPLE I

This Example illustrates the orientation of aluminum flake parallel to a horizontal surface using the process described hereinabove.

A 4 inch by 6 inch Bonderite 1000 surface treated steel panel is coated with an aluminum flake-containing acrylic polymer powder coating composition comprising 68% by weight of acrylic polymer, 1.25% by weight of aluminum flake, 29.3% by weight of a blocked triisocyanate, prepared by reacting three moles of 1-isocyanato-3-isocyanatomethyl-3,5,5-trimethylcyclohexane with 1 mole of 1,1,1-tris-(hydroxymethyl) propane in methyl isobutyl ketone followed by blocking with methyl ethyl ketoxime, and 1.25% by weight of phthalocyanine blue. The coated surface is heated to a temperature of 220° C. When the acrylic polymer composition melts, the panel is held at this temperature while a stream of air at 165° C. is blown substantially parallel to the coated panel for about 15 minutes. The coated panel is then heated for an additional 5 minutes to about 220° C. with a 5760 watt 12 × 12 inches Casso-Solar uniform heat infrared lamp (40 watts/in.$^2$) which is located 3 inches from the coated panel.

The hot air is provided by a Master Appliance Corp. Model No. H 6301-B (12 amp) air gun which is located 4 inches from the surface of the coated panel. The velocity of the air emitted from the air knife is about 8 feet per second and the air is heated to a temperature of 165° C. When both the Casso-Solar infrared heater and the air gun are on, the coating temperature is approximately 200° C.

After blowing the hot air across the coated panel for 15 minutes, the coated panel is then cured for 5 minutes at 220° C., and then is allowed to cool to room temperature (about 25° C.).

The entire process is carried out at substantially atmospheric pressure.

The coated panel has an appearance of depth which is similar to that obtained using a conventional solvent system metallic paint.

COMPARATIVE EXAMPLE

This Comparative Example illustrates the heating of a coated surface so as to cure a resin composition similar to that used in Example I without, however, employing the shear force created by the hot air stream of Example I.

A panel similar to that described in Example I is coated in a similar way and heated to a temperature of 200° C. for 20 minutes so as to cure the acrylic resin composition. The cured resin is then cooled to a temperature of 25° C. without employing the hot fluid stream.

The final coated panel lacks the appearance of depth of the panel in Example I because of the random orientation of the aluminum flake with respect to the surface. Whether looking at the coating face on or edge on, it generally looks the same. The color is generally rather dark.

EXAMPLE II

This Example illustrates the application of the present process to a contoured surface.

The coating described in Example I is applied to an automobile body using electrostatic spray equipment. A gas fired conventional oven or a gas fired high velocity oven such as commercially available from Blu-Surf of Thermal Engineering Corp. is used to melt the coating. The hot air stream may be provided by an "air curtain" adapted for this purpose. Such air curtains are available commercially from the Dynaforce Corp. of Old Bethpage, N.Y. and the Miniveil Corp. of New Castle, Pa. and are designed to have the air stream directed parallel to the contoured surfaces of the automobile. Temperatures produced by the combined effects of the oven and the air stream from the air curtain are about 185° C. The air flow velocity is about 8 feet per second.

The automobile passes into the oven and the powder coating is melted. Simultaneously, the air curtain provides the necessary air flow to achieve the desired platelet orientation.

After this, the automobile remains in the oven for another 5 minutes in order that the coating might be cured. The automobile then passes through the oven, cools to room temperature, and then proceeds to subsequent stations on the automobile assembly line.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. In a process for coating a metal-containing powder coating composition containing resin and metal platelets on a surface by (a) coating said metal-containing powder composition on said surface, (b) heating said coated surface in order to melt said metal-containing powder coating composition, (c) cooling said coated surface the improvement comprising:

blowing a stream of hot fluid substantially parallel to said coated surface simultaneously with heating step (b) for a time sufficient to orient said metal platelets substantially parallel to said surface, and cooling said coated surface as in step (c) after said metal platelets have become oriented substantially parallel to said surface.

2. The process of claim 1 wherein said metal-containing powder coating composition comprises from about 55 to about 95% by weight resin, from about 5 to about 45% by weight curing agent, and from about 0.5 to about 30% by weight metal platelets.

3. The process of claim 2 wherein said metal-containing powder coating composition additionally contains from about 1 to about 20% by weight pigment, wherein said fluid is air, and wherein said surface is horizontal.

4. The process of claim 1 wherein said fluid is provided by directing a stream of air at a temperature of from about 100° to about 250°0 C. and at substantially atmospheric pressure in a direction substantially parallel to said surface.

5. In a process for coating a metal-containing powder coating composition on a surface by (a) coating said metal-containing powder coating composition on said surface, (b) heating said coated surface in order to melt said metal-containing powder coating composition, (c) continuing to heat said coated surface until said resin becomes cured, and (d) cooling said coated surface wherein said metal-containing powder coating composition comprises from about 60 to about 90% by weight resin, from about 10 to about 35% by weight curing agent, and from about 1 to about 10% by weight metal platelets the improvement comprising:

blowing a stream of hot air substantially parallel to said coated surface simultaneously with said heating step (b) for a time suficient to orient said metal platelets substantially parallel to said surface, and cooling said coated surface as in a step (d) after said metal platelets have become oriented substantially parallel to said surface.

6. The process of claim 5 wherein said resin is an acrylic polymer, said metal is aluminum flake, and said curing agent is a blocked triisocyanate, prepared by reacting three moles of 1-isocyanato-3-isocyanatomethyl-3,5,5-trimethylcyclohexane with 1 mole of 1,1,1-tris-(hydroxymethyl)propane in methyl isobutyl ketone followed by blocking with methyl ethyl ketoxime.

7. The process of claim 5 wherein said metal-containing powder coating composition additionally contains from about 1 to about 10% by weight pigment, and wherein said hot air is provided by directing a current of air at a temperature of from about 125 to about 225° C. substantially parallel to said surface.

8. A process for coating an aluminum flake-containing acrylic powder coating composition on a horizontal surface, said aluminum flake-containing acrylic powder coating composition comprising from about 65 to about 85% by weight of an acrylic resin, from about 15 to about 30% by weight of blocked triisocyanate, prepared by reacting three moles of 1-isocyanato-3-isocyanatomethyl-3,5,5-trimethylcyclohexane with 1 mole of 1,1,1-tris-(hydroxymethyl) propane in methyl isobutyl ketone followed by blocking with methyl ethyl ketoxime, from about 1.25 to about 5% by weight of aluminum flake, and from about 1 to about 5% by weight of phthalocyanine blue pigment, such that, upon curing of said acrylic resin, said aluminum flake assumes an orientation parallel to said surface, said process comprising:

a. coating said aluminum flake-containing acrylic powder coating composition on said surface, b. heating said coated surface to a temperature of from about 175° to about 225° C. at substantially atmospheric pressure in order to melt said aluminum flake-containing acrylic resin composition, c. simultaneous with said heating step (b) blowing a stream of air which is at a temperature of from about 150° to about 200° C. substantially parallel to said surface at a velocity of from about 7 to about 15 feet per second and at a distance from said surface of from about 2 to about 4 inches for from about 10 to about 15 minutes so as to orient the aluminum flake substantially parallel to said horizontal surface, d. continuing to heat said coated surface until said resin becomes cured, and e. cooling said coated surface to a temperature of from about 20° to about 25° C. when said aluminum flakes have become oriented substantially parallel to said surface.

* * * * *